United States Patent [19]

Komura et al.

[11] Patent Number: 4,972,202

[45] Date of Patent: Nov. 20, 1990

[54] METHOD FOR DRIVING LIQUID-JET RECORDER

[75] Inventors: Hirokazu Komura, Hiratsuka; Masami Ikeda, Machida; Hiroto Matsuda, Ebina; Hiroto Takahashi; Makoto Shibata, both of Hiratsuka; Hisanori Tsuda, Atsugi, all of Japan

[73] Assignee: Canon Kabushiki Kaisha, Tokyo, Japan

[21] Appl. No.: 294,897

[22] Filed: Jan. 3, 1989

Related U.S. Application Data

[63] Continuation of Ser. No. 31,209, Mar. 30, 1987, abandoned, which is a continuation of Ser. No. 694,841, Jan. 25, 1985, abandoned.

[30] Foreign Application Priority Data

Jan. 30, 1984 [JP] Japan ..... 59-13314

[51] Int. Cl.[5] ..... B41J 2/05

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 3,967,092 | 6/1976 | Conta | 346/76 PH X |
| 4,345,262 | 8/1982 | Shirato | 346/140 |
| 4,353,079 | 10/1982 | Kawanabe | 346/140 R |
| 4,355,319 | 10/1982 | Takeuchi | 346/76 PH |
| 4,429,321 | 1/1984 | Matsumoto | 346/140 |
| 4,450,457 | 5/1984 | Miyachi | 346/140 |
| 4,463,359 | 7/1984 | Ayata et al. | 346/1.1 |
| 4,479,132 | 10/1984 | Iwakura | 346/76 PH |
| 4,479,134 | 10/1984 | Kawanabe | 346/140 R |
| 4,520,373 | 5/1985 | Ayata et al. | 346/140 R |
| 4,536,250 | 8/1985 | Ikeda et al. | 156/651 |
| 4,567,493 | 1/1986 | Ikeda et al. | 346/140 R |
| 4,602,261 | 7/1986 | Matsuda et al. | 346/140 R |
| 4,626,875 | 12/1986 | Hara et al. | 346/140 |
| 4,631,555 | 12/1986 | Ikeda et al. | 346/140 R |
| 4,686,544 | 8/1987 | Ikeda et al. | 346/140 R |
| 4,723,129 | 2/1988 | Endo et al. | 346/1.1 |
| 4,725,859 | 2/1988 | Shibata et al. | 346/140 R |

*Primary Examiner*—Joseph W. Hartary

*Attorney, Agent, or Firm*—Fitzpatrick, Cella, Harper & Scinto

[57] ABSTRACT

A method for driving a liquid-jet recorder having electric heaters for forming flying liquid droplets by jetting a liquid is characterized by applying no voltage to the electrodes of each electric heater for the moments the heater is not driven during the operation of the recorder.

6 Claims, 1 Drawing Sheet

METHOD FOR DRIVING LIQUID-JET RECORDER

This application is a continuation of application Ser. No. 031,209 filed Mar. 30, 1987, now abandoned, which is a continuation of application Ser. No. 694,841, filed Jan. 25, 1985, now abandoned.

BACKGROUND OF THE INVENTION

1. Field of the Invention

The present invention relates to a method for operating liquid-jet recorders to record images by flying liquid droplets formed by liquid-jet.

2. Description of the Prior Art

Recently ink-jet recording (a liquid-jet recording method) attracts attention in that if generates very little noise, of such a degree as to be negligible, it makes high speed recording possible, and additionally it permits recording on plain paper without requiring special fixing treatment.

Among various liquid-jet recording methods, those described, for example, in Japanese Patent Application Laid-Open No. 51,837/1979 and German Patent Application Laid Open (DOLS) No. 2,843,064 are distinguished from other liquid-jet recording methods in that the driving force to eject liquid droplets in these methods is obtained by exerting thermal energy on a liquid.

That is, according to the recording methods disclosed in the above patent applications, a state change accompanied by a rapid volume increase is caused in a recording liquid by the action of thermal energy thereupon, and droplets of the recording liquid are ejected because of the state change, through an orifice in the front end of a recorder head to form flying droplets that are directed to a recording medium, thereby making a record.

In particular, the recording method disclosed in DOLS No. 2,843,064 is featured in that it can be applied very effectively to the so-called drop-on-demand recording method and in addition can give high quality images of high resolution at high speeds since it facilitates the realization of a full-line type of recorder head having densely aligned multi-orifices.

The recorder head used in the above-mentioned recording method is provided with (1) orifices for discharging droplets, (2) liquid flow paths which are in communication with the orifices, respectively, each of which flow paths includes a heat exerting section that applies thermal energy to the liquid so as to jet droplets of the liquid, and (3) electricity-to-heat converters (electric heaters) as a means of generating thermal energy.

Each electric heater has a pair of electrodes, on a support, and a heat-generating resistor layer comprising a heat-generating section in contact with the electrodes and therebetween.

Conventionally a liquid-jet recorder is operated by a driving system as shown in FIG. 1.

In FIG. 1, 4 is an electrode and 5 is a heat-generating resistor layer, which are connected to a power source 1. The flying droplets are formed by applying signals 3 to a switching element 2 that is, by the ON and OFF states of each switching element 2. The pair of electrodes 4 and the heat-generating resistor layer 5 are in contact with the ink filled in the corresponding liquid flow path, through a protecting layer (not depicted). This protecting layer is constructed of a material superior in properties such as heat resistance, liquid resistance, liquid-penetration preventive property, anti-oxidation property, breakage or flow resistance, etc., but no material completely satisfying in these properties has been obtained. In the above driving system, the heat-generating resistor layer and the electrodes often have positive potential and the ink has negative potential even for the moments when the driving is stopped. Hence, for instance, if a dielectric breakdown of the protecting layer occurs, an electro-chemical reaction will be caused between the electrode and the ink. This is responsible for significant shortening of the liquid-jet recorder life.

SUMMARY OF THE INVENTION

The invention has been made in view of the above noted point.

Thus, an object of the invention is to provide a method for driving liquid-jet recorders, by which the recorders will exhibit superior overall durability in frequently repeated operations or long continuous operations and can retain uniformily the initial good characteristics for droplet formation over the long terms.

Another object of the invention is to provide a method for driving a liquid-jet recorder having electric heaters for forming flying liquid droplets by jetting a liquid, characterized in that no voltage is applied to the electrodes of each electric heater when the heater is not driven during the operation of the recorder.

DETAILED DESCRIPTION OF THE PREFERRED EMBODIMENTS

Figure 1:
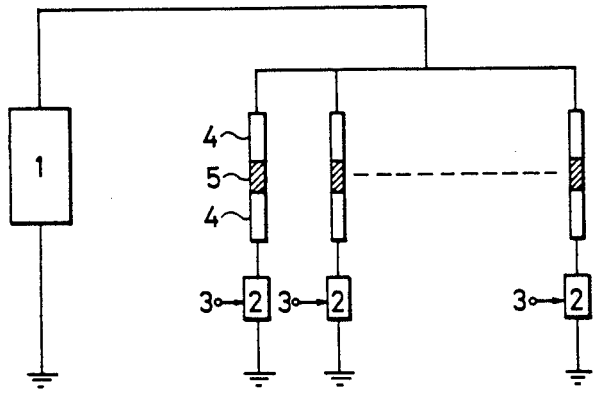
FIG. 1 PRIOR ART
FIG. 1 is a schematic diagram illustrating the concept of the conventional method for driving a thermal actuation type of liquid-jet recorder head.
Figure 2:
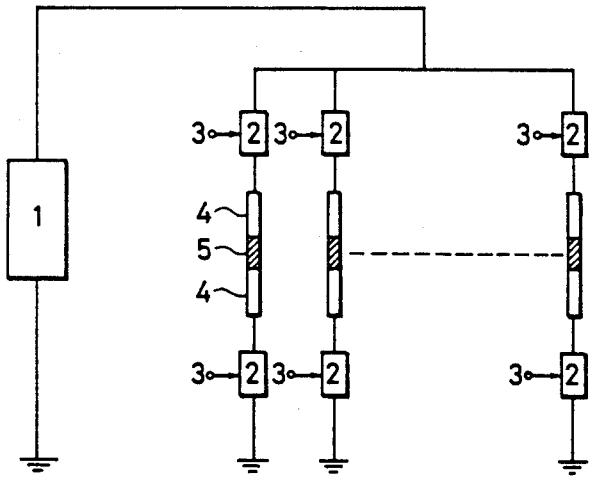
FIG. 2 is a schematic diagram illustrating the concept of the method of the invention for driving the above type of liquid-jet recorder head.

According to the invention, no voltage is applied to the electric heater electrodes in the thermal actuation type of liquid-jet recorder for the non-drive moments. A concrete means of applying no voltage to the electrodes for the non-drive moments is to incorporate a switching element in addition to the hitherto incorporated switching element on the side opposite thereto (electrode side) of the electric heater. A driving system of the invention provided with this means is shown in FIG. 2. The notation in this figure is as explained regarding FIG. 1. The same signal is applied to both the switching elements formed the both side of one pair of electrodes in FIG. 2 at the same time. According to this driving system, the electrodes 4 and the heat-generating resistor layer 5 for the non-drive moments, viz. when no pulse is applied to the switching elements, can have any potential and hence will take the same potential as that of the ink even if a dielectric breakdown of the protective film occurs, so that any electro-chemical reaction will not take place between the ink and the heat-generating resistor layer 5 and the electrodes 4. Consequently, it is possible to avoid the breakdown and galvanic corrosion of the heat-generating resistor layer 5 and of the electrodes 4 and to extend the life of the liquid-jet recorder.

Under actual recording conditions, the period of applying no pulse, i.e. the switch OFF time, is longer than the period of applying a pulse. For instance, when the driving frequency is 1 KHz and the pulse width is 10 μs, the period of applying no pulse is 100 times the period of applying a pulse. In addition, the ON state of the power source when no signal is applied to the switches is identical with the state of applying no pulse. Accordingly, the non-drive period, i.e. the period of applying no pulse, is considered to be at least 1000 times the period of applying a pulse. Therefore, it is important for extending the life of the liquid-jet recorder head that the electro-chemical reaction is suppressed in the non-drive periods.

Figure 3:
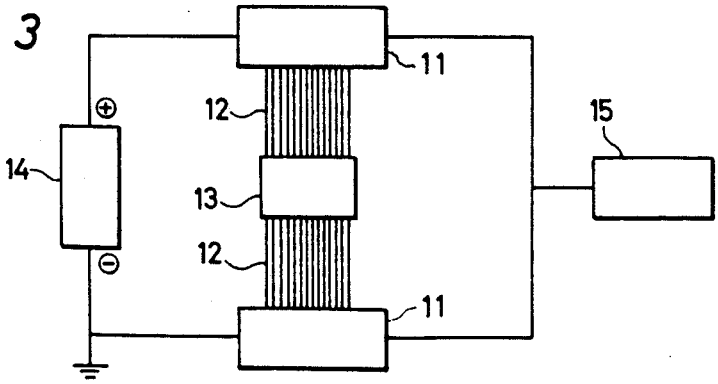
FIG. 3 is a schematic diagram of a driving system used in the method of the invention for driving the above type of liquid-jet recorder head.

FIG. 3 illustrates a driving system according to the method of the invention.

In the figure, 11 is a driver, 12 represents cords connecting a liquid jet recorder head 13 to the drivers 11, 14 is a power source, and 15 is a signal-applying means. The two drivers 11 are connected respectively, on the output sides, to the electrodes attached to the heat-generating resistor layer of the liquid-jet recorder head 13. Signals are applied from the signal applying means 15 to two drivers. Depending on the signals, the output of each driver becomes in the ON or OFF state. When the output is in the OFF state, the heat-generating resistor layers and the electrodes in the liquid-jet recorder head have no potential. While the protecting layers covering the heat-generating resistor layers and the electrodes are formed of an inorganic or organic material, the ink-shielding function thereof is usually deteriorated by long-term contact thereof with ink and the leakage often occurs. But, according to the driving method of the invention, the heat-generating resistor layers and the electrodes have the same potential as does the ink for the non-drive moments, and therefore undergo no such electro-chemical decomposition or galvanic corrosion as will be caused by the leakage.

As an example, the following test was conducted. Dipping two liquid-jet recorder heads having the same structure in an ink at 80° C., a positive potential was applied to the electrodes of one of the recorder head and a negative potential (GND) to the ink, while no potential was applied to the electrodes of the other recorder head and the same negative potential (GND) was applied to the ink. As a result, breakage was observed in the electrodes of the former recorder head in 8 hours, but no change was found in the electrodes of the latter recorder head after 6 months. In this test, $SiO_2$ films inferior in quality were used as the protecting layers for the purpose of reducing the test time.

As described hereinbefore, it is possible according to the driving method of the invention to suppress the electro-chemical reaction of the ink with the heat-generating resistor layers and with the electrodes for the non-drive moments, and to reduce the disorder of liquid-jet recorder heads. In consequence, the life of liquid jet recorders can be extended.

For the switching elements, generally known elements, for example, transistors, can be used. While an example of applying signals to switching elements in the method of the invention has been taken above, a combination of plural transistors, for example, can also be used as the switching element.

What we claim is:

1. A method for operating a liquid jet recorder, the method comprising the steps of:

providing a liquid jet recording head including (a) a support having thereon a plurality of electrothermal transducers for heating liquid to eject liquid droplets from said recording head, wherein each said electrothermal transducer comprises a resistor associated with a pair of electrodes, said resistor being electrically connected between said pair of electrodes and in electrical isolation from resistors of other said electrothermal transducers for generating heat when said electrothermal transducer is driven by applying a voltage to said electrodes and across said resistor, (b) an electric power source for applying a voltage to said electrodes, and (c) a switching element electrically connected between each of said electrodes and said electric power source for selectively connecting and disconnecting said electrothermal transducers and said electric power source in response to a driving signal applied to said switching elements; and driving at least one selected said electrothermal transducer by selectively applying a driving signal only to said switching elements connected to pairs of electrodes associated with a selected electrothermal transducer to connect said pair of electrodes associated with said at least one selected electrothermal transducer to said electric power source at the same time and to disconnect said pair of electrodes from said electric power source in the absence of a driving signal.

2. The method according to claim 1, wherein said electrothermal transducers have a protecting layer thereon.

3. The method according to claim 2, wherein the protecting layer is an inorganic material.

4. The method according to claim 2, wherein the protecting layer is an organic material.

5. The method according to claim 1, wherein each said switching element is a transistor.

6. The method according to claim 9, wherein each of said switching elements is associated with one of said electrodes.

* * * * *

UNITED STATES PATENT AND TRADEMARK OFFICE

CERTIFICATE OF CORRECTION

PATENT NO. : 4,972,202

DATED : November 20, 1990

INVENTOR(S) : Hirokazu KOMURA, ET AL.

It is certified that error appears in the above-identified patent and that said Letters Patent is hereby corrected as shown below:

COLUMN 1:

Line 17, "if" should read --it--; and

Line 33, "ejected" should read --ejected,--.

COLUMN 2:

Line 19, "uniformily" should read --uniformly--;

Line 20, "terms." should read --term.--; and

Line 52, "formed the both side of" should read --corresponding to--.

COLUMN 4:

Line 53, "claim 9," should read --claim 1,--.

Signed and Sealed this

Twenty-eighth Day of July, 1992

*Attest:*

DOUGLAS B. COMER

*Attesting Officer*

*Acting Commissioner of Patents and Trademarks*